US007044342B2

(12) United States Patent
Carlton

(10) Patent No.: US 7,044,342 B2
(45) **Date of Patent: *May 16, 2006**

(54) HAND HELD FUEL CONTAINER

(76) Inventor: Douglas C. Carlton, 1115 Heatherwoode, Flint, MI (US) 48532

( * ) Notice: Subject to any disclaimer, the term of this patent is extended or adjusted under 35 U.S.C. 154(b) by 223 days.

This patent is subject to a terminal disclaimer.

(21) Appl. No.: 10/626,964

(22) Filed: Jul. 26, 2003

(65) Prior Publication Data

US 2004/0084485 A1 May 6, 2004

Related U.S. Application Data

(63) Continuation-in-part of application No. 29/170,282, filed on Nov. 4, 2002, now Pat. No. Des. 503,610.

(51) Int. Cl.
*B67D 3/00* (2006.01)

(52) U.S. Cl. ..... 222/481.5; 222/482; 222/527

(58) Field of Classification Search ..... 222/481.5, 222/482, 527, 529, 530
See application file for complete search history.

(56) References Cited

U.S. PATENT DOCUMENTS

| | | | | | |
|---|---|---|---|---|---|
| 1,913,895 | A | * | 6/1933 | Paull | 222/487 |
| 4,921,147 | A | * | 5/1990 | Poirier | 222/527 |
| 4,972,972 | A | * | 11/1990 | Goguen | 222/130 |
| 5,597,097 | A | * | 1/1997 | Morris | 222/529 |
| 5,667,113 | A | * | 9/1997 | Clarke et al. | 222/608 |
| 5,810,213 | A | * | 9/1998 | Flores et al. | 222/610 |
| D503,610 | S | * | 4/2005 | Carlton | D9/683 |

* cited by examiner

*Primary Examiner*—Philippe Derakshani
(74) *Attorney, Agent, or Firm*—The Weintraub Group, PLC

(57) ABSTRACT

A portable hand held fuel container includes a pour tube, a fill tube spaced from the pour tube, a removable closure cap to close the inlet end to the fill tube, a vent arrangement in the closure cap that permits and prevents exterior air to enter to fill tube to enhance pouring and during pouring inhibits fluid flow through the fill tube in case of overturning of the container, and a vapor seal member connected to the pour tube that is adapted during pouring to simultaneously seal about the fuel inlet to a fuel receiving tank and axially compress to permit deep insertion of the discharge end of the pour tube into the receiving tank.

19 Claims, 3 Drawing Sheets

HAND HELD FUEL CONTAINER

This Application is a continuation-in-part of U.S. patent application Ser. No. 29/170,282, filed on Nov. 4, 2002, now U.S. Pat. No. Des. 503,610 the disclosure of which is hereby incorporated by reference.

BACKGROUND OF THE INVENTION

1. Field of the Invention

This invention relates to portable hand held fuel containers that include an opening for filling and pouring fuel from the container and a vent cap that is openable to allow air to enter the container and enhance pouring, and more particularly, to such a container wherein a pour tube is separate from a fill tube, the vent cap is connected to the fill tube and inhibits fluid flow therethrough in case of overturning of the container during pouring, and a vapor seal member is connected to the pour tube and adapted during dispensing to simultaneously seal about the fuel inlet to a receiving tank and axially compress to permit deep insertion of the discharge end of the pour tube into the receiving tank.

2. Description of Related Art

Portable hand held fuel containers are known. Typically, the container provides a chamber into which gasoline or other suitable fluid (e.g., diesel fuel or mineral spirits) is placed and then either stored, until needed, and then transported and transferred to apparatus where needed.

Such containers typically include an elongated pour tube or spout for discharging fuel from the container and into a receiving tank, and a venting arrangement to promote fuel discharge from the container. The top wall of the container is provided with an opening, which opening forms both an inlet for receiving and refilling the container with fuel and an outlet for discharging fuel. In practice, one end of the pour tube is connected to the opening and fuel is discharged from the other end.

Typically, the vent arrangement comprises a closure cap that is snap-fitted into another opening formed in the container wall. Removal of the closure cap enables air to flow into the interior of the container to enhance fluid flow through the pour tube.

In use, the elongated pour tube is inserted into the opening of a receiving tank or other apparatus into which the fuel is to be transferred. Because the pour tube has a fixed diameter and is clearance fit within an opening of different but smaller diameter, an annulus is formed around the interface between the pour tube and the receiving tank. This annulus permits vapor to escape into the atmosphere.

In recent times, particularly in smog-plagued communities like the state of California, laws have been passed to minimize emissions from portable gas cans as well as from the tank receiving the gas from the gas can. Indeed, the California Air Resources Board ("CARB") now regulates the type of gas can that may be sold in California.

Desirably, the gas can would be such as to both seal the container and the receiving tank from emissions as well as permit entry of the spout into the receiving tank while accomplishing the vapor emissions sealing function.

The provision of a venting arrangement in such containers is also known. In some cases, as noted hereinabove, a snap-open closure plug is spaced from the pour spout and snap-fitted into an opening provided in the wall of the gasoline container. In other arrangements, an air vent is associated with the pour spout. Desirably, the air venting arrangement would inhibit the leakage (i.e., spillage) of gas therethrough should the container overturn.

It is thus an object of this invention to provide a hand held portable gasoline container that overcomes the disadvantages of the prior art.

A further object of this invention is the provision of a portable handheld fuel container which advantageously permits the fluid pour spout to fit gasoline inlets of different diameters in such a way as to minimize vapors escaping while fuel is being dispensed, inhibit spillage and evaporation through venting holes, inhibit spillage as fuel is being dispensed, and inhibit evaporation and spillage during transportation and storage of the container.

SUMMARY OF THE INVENTION

The present invention is directed to a portable hand held fuel container, comprising

- a pour tube having a lower end connected to the container and an outlet end for dispensing fuel from the container,
- a fill tube having a lower end connected to the container and an inlet end for introducing fuel into the container, said fill tube being separate and apart from the pour tube,
- a removable closure cap to close the inlet end to the fill tube,
- a vent arrangement in the closure cap that permits and prevents exterior air to enter to fill tube to enhance pouring and inhibit fluid flow through the fill tube in case of overturning of the container, and
- a vapor seal member connected to the outlet end portion of the pour tube, said seal member being adapted during pouring to simultaneously seal about the fuel inlet to a fuel receiving tank and axially compress rearwardly of the outlet end wherein to permit deep insertion of the outlet end of the pour tube into the receiving tank.

According to one aspect of this invention, the vapor seal member comprises a cylindrical sleeve, said sleeve having a rearward and forward end portion, respectively, fixed to and movably disposed at the dispensing end of the pour tube. Preferably, the cylindrical sleeve is comprised of a continuous succession of longitudinally spaced undulations to enable axial compression of the sleeve. Further, the forward end portion of the sleeve forms a frusto-conical end face, the end face being adapted to force the sleeve axially rearwardly upon engagement with the fuel tank.

According to another aspect of this invention, the closure cap is juxtaposable, at least in part, and removable mountable in closed sealed relation, against the inlet end of the fill tube, and includes the vent arrangement. Further, the vent arrangement comprises said closure cap including an air passage that extends between the outside and interior surfaces of the cap, and an elongated valve stem to open and close the air passage, the stem being movable relative to the closure cap.

In a particular embodiment of the vent arrangement, the valve stem includes an upper end portion positionable above the upper (and outside) surface of the cap and a lower end portion that is positionable within a chamber formed within the cap. The air passage is comprised of the central chamber, a first passageway extending through the stem for communicating air into the chamber, and a second passageway extending through the lower surface of the cap and into the fill tube. The first passageway includes a radial passageway that is locatable upon movement of the valve stem to be either above the upper surface, wherein to permit air to enter into the chamber, or below the upper surface and into closed relation, wherein to prevent air from entering the chamber.

In the above noted permitting and preventing positions of the radial passageway, fuel is either inhibited or prevented from leaving the container.

Desirably, the valve stem is threadably engaged with the closure cap, to enable incremental adjustment thereof between open and closed positions, and a valve head to facilitate such positioning. Such positioning capability enables the user to increase the amount of external vent air that is passed from the outside of the gas can, wherein to enhance a smooth pouring action.

Further, elastomeric seal members are provided to seal the interfaces between (1) the valve head and the upper surface of the closure cap, and thus about the radial passageway when the head is in the closed position, and (2) the lower surface of the cap and the inlet end face of the fill tube, when the cap is closingly secured to the fill tube.

Desirably, the container is provided with a handle, which includes lower and upper handle portions to enable the user to grip the container and position the pour tube during dispensing of fuel from the container. In this regard, the lower handle portion is connected to the sidewall and to the lower end portion of the fill tube, and the upper handle portion comprises, at least in part, the upwardly projecting end portion of the fill tube.

The foregoing summary, as well as the following detailed description of preferred embodiments, will be better understood when read in conjunction with the accompanying drawings, wherein like numerals refer to like parts throughout. For illustrating the invention, there is shown in the drawings a preferred embodiment, it being understood, however, that the invention is not limited to the specific methods and instrumentalities disclosed. In the drawings:

DESCRIPTION OF A PREFERRED EMBODIMENT OF THE INVENTION

Figure 1:
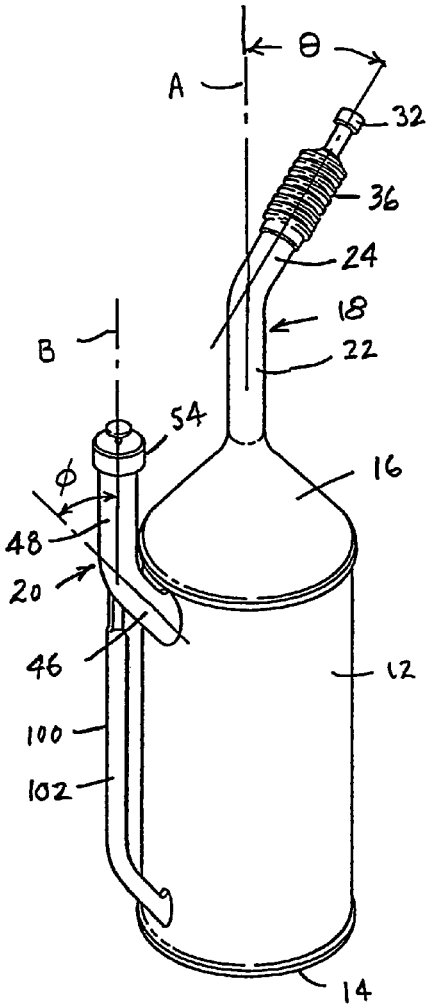
FIG. 1 is a perspective view illustrating a portable, hand held fuel container embodying the invention.

As shown in the drawings for the purposes of illustration, the invention is embodied in a portable, hand held, fuel container, generally indicated at 10. Depending on the fluid stored and/or carried, the container is sometimes referred to as a "gas can".

The fuel container 10 comprises a generally cylindrical sidewall 12, a generally flat bottom wall 14, and a generally frusto-conically shaped upper endwall 16, the walls 12, 14 and 16 being generally symmetrically centered on a common geometrical axis "A" that extends through the center of the container. Preferably, the container 10 is integrally formed from a suitable polymer and the walls thereof define an interior fluid chamber for storing or transporting fuel.

The container 10 is formed to include a pour tube or spout 18 and a fill tube 20, each tube communicating with the interior fluid chamber of the container. According to an important aspect of this invention, the pour tube 18 is separate and apart from the fill tube 20.

The pour spout 18 is hollow, generally cylindrical, and is adapted to direct, dispense or otherwise discharge fluid from the container at an acute angle to the central axis of the container. The pour spout 18 is comprised of a rearward tube portion 22 and a forward tube portion 24, the rearward tube portion 22 being at an acute angle $\Theta$ to the forward tube portion 24. The rearward tube portion 22 is axially aligned with the center axis of the container 10 and the geometrical center of the frusto-conical endwall 16. That is, the rearward end of the tube portion 22 is formed as a continuation of the endwall 16.

The tube portion 24 includes a forward end portion 26 and a forward end that defines a discharge opening 28 for dispensing or pouring fluid from the container.

Preferably, as is known in the art, the forward end portion 26 of the pour spout 18 is provided with thread 30 wherein to enable a spill or closure cap 32 to be removably secured thereto. The spill cap 32 operates to seal the discharge opening, wherein to inhibit gases to escape or fluid to spill from the container.

Preferably, and according to this invention, the forward end portion 26 is smaller in diameter than that of the tube portion 24, and a transition portion 34 joins the portion 24 and 26. As shown best in FIG. 3, the transition portion 34 is frusto-conical in shape and forms a wall or stop, in a manner to be discussed herein below.

Further, and according to an important aspect of this invention, an elongated, axially compressible, cylindrical sealing sleeve 36 is circumposed, in part, about the forward tube portion 24 and forward end portion 26 of the pour spout 18. As shown best in FIG. 3, the sealing sleeve 36 has a rearward end 38 and a forward end 40. The rearward end 38 is fixedly connected in 360° sealed relation to the outer periphery of the tube portion 24. The forward end 40 is circumposed about the forward end portion 26 and is located between the discharge opening 28 and the stop 34.

Preferably, the sealing sleeve 36 comprises a continuous succession of longitudinally spaced undulations or cylindrical ribs and characterized by a series of peaks and valleys 42 and 44. The cross-section of the sealing sleeve 36 forms a corrugated or bellows-like member. The forward end 40 of the sleeve 36 is generally frusto-conical and centrally apertured at 46, the aperture 46 forming a clearance fitment about the outer periphery of the forward end portion 26.

Importantly, the sealing sleeve 36 is comprised of a resilient polymer. Further, the undulated nature of the sleeve 36 enables the sealing sleeve 36 to act as a spring member, enabling the sleeve to axially compress and return to its original shape.

In operation, the forward end portion 26 of the forward tube portion 24 is inserted into the inlet opening of a receiving tank (not shown). Progressive insertion of the end portion 26 positions the discharge end 28 into the receiving tank and brings the forward end 40 of the sealing sleeve 36 into sealing engagement with and about the inlet opening. Vapors from fuel thus dispensed into the tank are inhibited from escaping from the dispensing end 28 and into the atmosphere.

Simultaneously and with further inward insertion, the sleeve member 36 axially compresses, exposing more of the forward end portion 26 encircled by the sleeve member 36. As a result, the forward end portion 26 and the discharge end 28 may be inserted even deeper into the receiving tank. Depending on the sealing sleeve 36 and its location relative to the pour tube 18, the frusto-conical wall 34 will form a stop to limit rearward compression of the sealing sleeve 36 as well as insertion of the forward end portion into the receiving tank.

Figure 4:
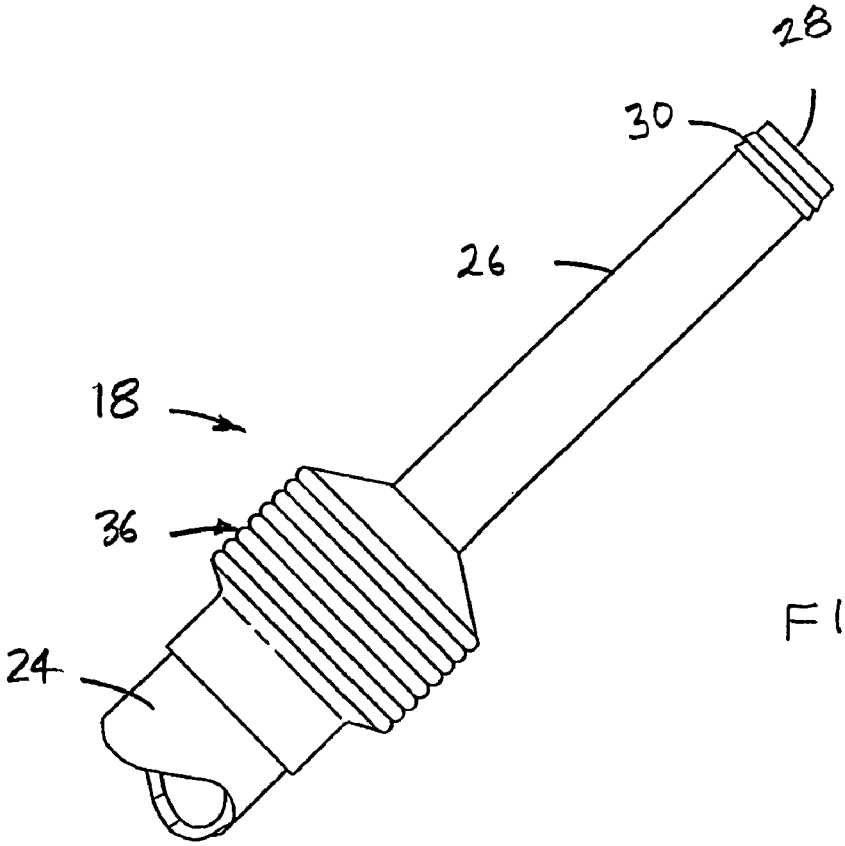
FIG. 4 is an enlarged view of the forward end portion of the pour spout wherein the bellows has been axially compressed to expose and permit a greater length of the pour spout to be inserted into the receiving tank.

FIG. 4 illustrates a condition of the sealing sleeve 36 following maximum insertion of the pour spout 18 into the receiving tank (not shown). The sealing sleeve 36 has undergone full axial compression and the maximum length of the forward end portion 26 has been exposed, resulting in the discharge end 28 being inserted as far as possible into the receiving tank.

Figure 2:
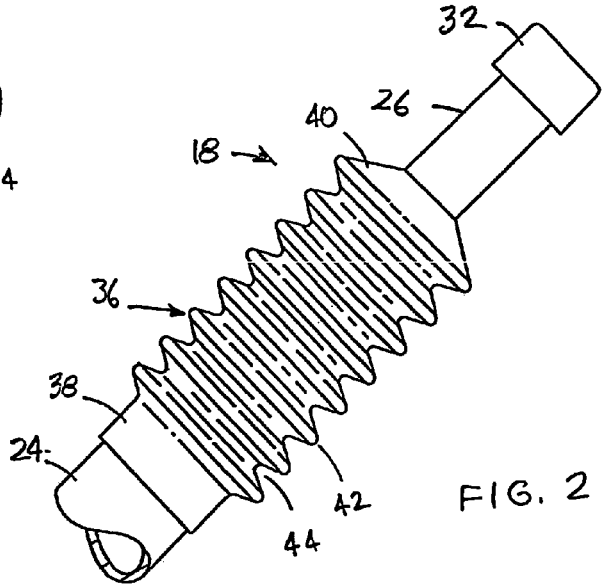
FIG. 2 is an enlarged view of the forward end portion of a pour spout of the fuel container shown in FIG. 1 and a collapsible bellows thereof when axially extended, the forward end face of the bellows forming a closure about the inlet to the receiving tank during insertion of the pour spout thereinto.
Figure 3:
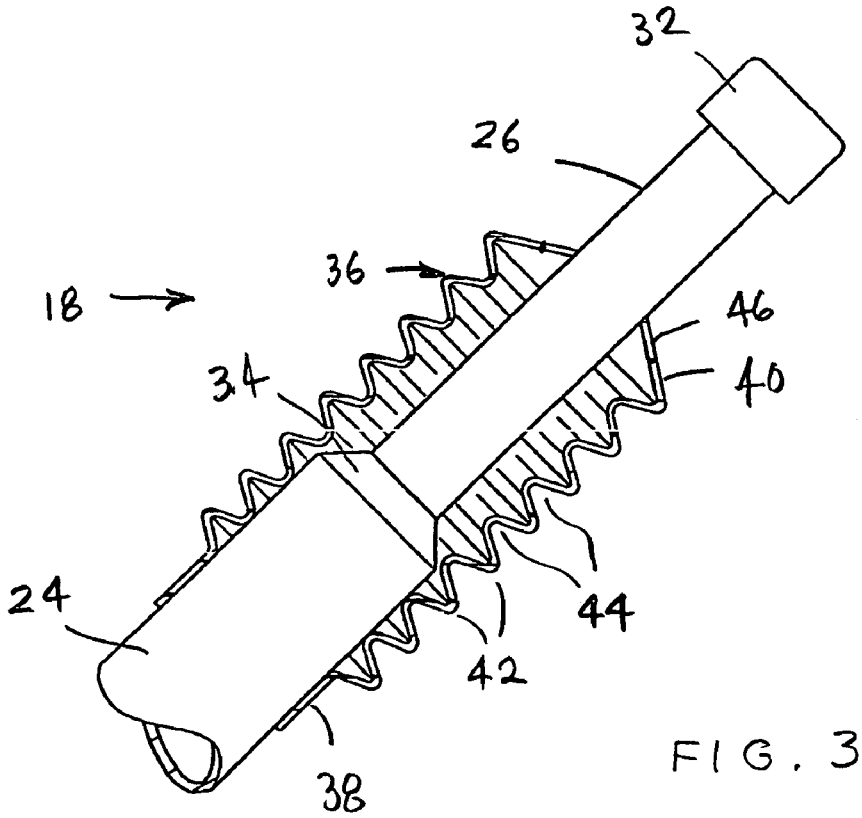
FIG. 3 illustrates, in partial section, the pour spout shown in FIG. 2.

Upon withdrawal, the sealing sleeve 36 expands to its original axial length, as shown in FIGS. 1–3.

The fill tube 20 is hollow, generally cylindrical, and is adapted to receive and introduce fluid into the container. The fill tube 20 is comprised of a rearward tube portion 46 and a forward tube portion 48, the rearward tube portion 46 being at an acute angle Φ to the forward tube portion 48 and formed with the sidewall 12. The forward end portion 48 is disposed on an axis "B" that is in parallel relation to the center axis "A" of the container 10 and has an end face 50 disposed in a plane generally perpendicular to the axis "A". The end face 50 defines an inlet 52 that is used to introduce fluid into the fill tube 20, therein to fill and/or refill the container with fluid. The inlet 52 and the narrowed portion between the endwall 16 and the pour tube 18 are generally in the same plane.

To prevent spillage from the container 10, a closure cap 54 is threadably secured to thread 56 formed about the forward end portion 48, the thread 56 being proximate to the inlet 50.

Further, to promote a reasonably smooth flow of fluid from the interior storage chamber of the container 10 and into the pour spout 18, the closure cap 54 is provided with an air vent arrangement.

Figure 5:
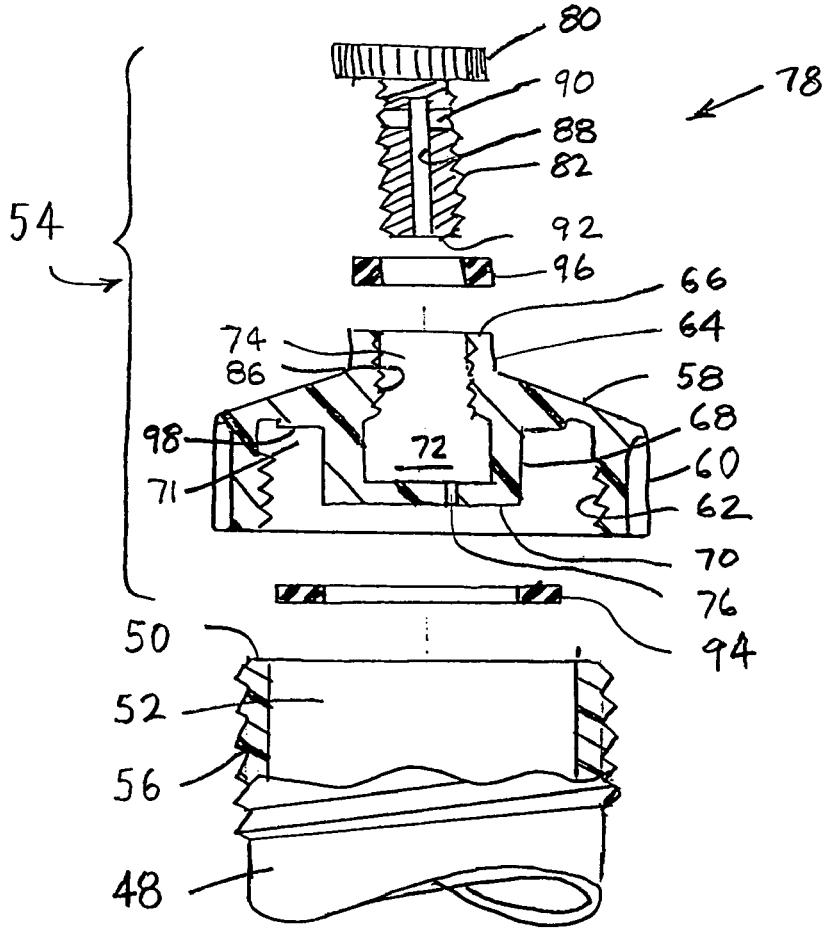
FIG. 5 is an exploded assembly view, in section, of a closure cap having a vent arrangement, according to the invention, positioned for closing connection with the inlet end of a fill tube.

Preferably and referring to FIG. 5, the closure cap 54 according to this invention is generally cylindrical and includes a circular top wall 58, and a cylindrical side wall 60, the sidewall encircling the top wall 58 and having thread 62 formed on the interior wall thereof to engage with the thread 56 on the fill tube 20. A cylindrical boss 64 is formed centrally of the top wall, the boss projecting upwardly therefrom to an end face 66. A cylindrical housing 68 is formed centrally of the top wall 58, the housing projecting downwardly therefrom to an end face 70 and dimensioned to clearance fit within the inlet 52. An annular space 71 is formed between the side wall 60 and the outer periphery of the housing 68.

An air path extends between the end faces 66 and 70. In this regard, an interior chamber 72 is formed in the housing 68, a bore 74 extends through the boss 64 and between the end face 66 thereof and into the chamber 72, and a passage 76 extends between the end face 66 of the housing 68 to the chamber 72 therewithin.

Further, a threaded fastener 78 having a head 80 and an elongated stem or body 82 having exterior thread 84 is provided to threadably interengage with thread 86 formed on the interior wall of the bore 74, whereby the fastener 78 may incrementally advance towards or away from the end face 66 of the boss 58.

According to this invention, the fastener 78 is uniquely designed to provide the threaded stem 82 with a central bore 88 and a radial passage 90 adjacent to the head 80. The central bore 88 extends generally coaxially through the interior of the stem 82 from the forward end 92 thereof to the head 80. The radial passage 90 extends transversely across the stem 82, intersecting the central bore 88 and opening on the exterior threaded surface of the stem 82.

To assist in maintaining a fluid tight seal, the closure cap 54 is provided with a pair of seal members 94 and 96. The seal member 94 is seated against a boss or land 98 within the annulus 71 formed about the housing 68 and adapted to be compressed into sealed relation by the end face 50 of the fill tube 20 when the closure cap 54 is tightly secured thereto.

The seal member 96 is adapted to be compressed between the end face 66 of the boss 64 and head 80 of the threaded fastener 78 the end face of the fill tube. The seal member 78 is proximate to the radial passages 74 and ensures that when head 80 of the fastener 78 is moved downwardly and pressed against the seal member 96, the radial passages 74 is disposed within the bore 88 and no air or fluid may escape from the container 10.

Contrariwise, when the head 80 of the fastener 78 is retracted from the end face 66, the radial air passage 90 is positioned to allow air to enter the central passage 88, but is small enough to inhibit fluid exiting therethrough.

Figure 6:
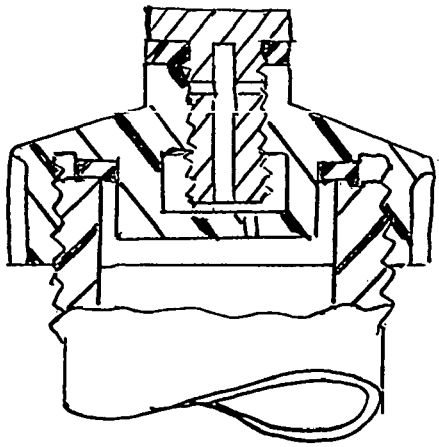
FIG. 6 is a section view of the closure cap and venting arrangement, according to this invention, in a closed position.

FIG. 6 illustrates the closure cap 54 when connected to the end of the fill tube 20 and in sealed non-venting relation therewith. In this situation, the threaded fastener 78 has been advanced into the closure cap 54 such the radial passage 90 is disposed within and closed by the bore 88. In this position, the passage of venting air to the interior chamber of the container 10 from outside the container via the radial passage 74, the central passage 88, the chamber 72, and the passage 76 is prevented. Spillage and vapor emissions are prevented.

In use, the threaded fastener 78 would be rotated in such manner that the threaded stem 82 and radial passage 90 would be moved upward and away from the seal member 96 mounted atop the end face 66 of the boss 64. Sufficient upward rotation of the threaded fastener 78 results in the radial passage 90 being brought into communication with outside air, thus enabling air to pass through the radial passage 90, the central bore 88, the chamber 72, the passage 76 in the bottom of the housing 68, and into the interior storage chamber of the container 10.

To promote sealing, the forward end face 92 of the threaded fastener 78 is frusto-conical in shape and the interior surface of the bottom wall of the housing 68 is provided with a matching frusto-conical recess (not shown). The length of the stem 82 of the fastener 78 is dimensioned such that the shaped end face sealingly seats within the recess when the radial passage 90 is blocked by the interior wall of the central bore 86.

Preferably, the fuel container 10 is integrally molded of a suitable material that is impervious to chemical attack, impact resistant, and non-corroding. A suitable material is a heavy gauge, lightweight, formulated high-density plastic, such as polyethylene.

Further, the container 10 is provided with a handle 100 to facilitate positioning of the pour and fill tubes 18 and 20. In a preferred embodiment, the handle 100 is integral with the sidewall and includes, at least in part, the upward end portion of the fill tube 20, and a lower handle portion 102.

In such handle 100, the user may advantageously grip the lower portion 102 of the handle with one hand and an upper portion of the fill tube with the other hand, which portion is above the upper end wall of the container. The handle 100 provides the user with a two point gripping relation with the container 10, enabling the pour tube 18 to be positioned more easily when the container is full or extremely large, and thus awkward and heavy.

In the fuel container 10 illustrated herein above, the vapor sealing arrangement is fixedly attached to the forward end portion of the pour tube 18. As contemplated herein, the vapor sealing arrangement is intended to be removably attached to the gas can 10 as a subassembly.

According to this aspect of the invention, the vapor sealing subassembly (not shown) is removably attached to thread provided at the end of the tube 24. The vapor sealing assembly comprises a section of tubing, the axially compressible sealing sleeve 36, and a coupling nut. The coupling nut is positioned at the rearward end portion of the section of tubing for connection with tread formed externally about the forward end of the tube 24.

The section of tubing has a rearward end, the intermediate wall 34, and the forward end portion 26. The rearward end 38 of the sealing sleeve 36 is fixedly connected to the rearward end portion of the tubing section (in a manner described hereinabove with reference to the tube 24.

Desirably, such removablity enables different pour spouts and vapor seal assemblies to be used in connection with the fuel container 10. For example, such connectability enables the use of the pouring spout 136 as disclosed in U.S. Pat. No. 4,921,147, issued May 1, 1990 to Poirier, the disclosure of which is incorporated herein by reference.

Figure 7:
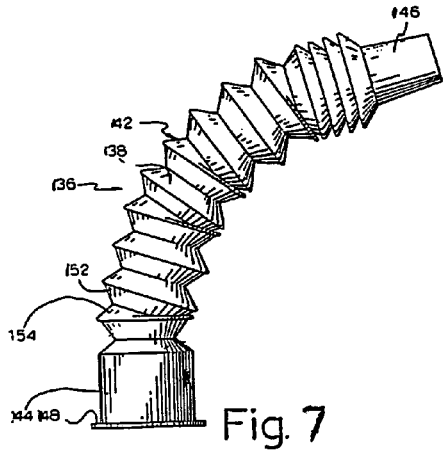
Fig. 7 PRIOR ART
FIG. 7 is an enlarged elevational view of a prior art flexible pour spout.

Briefly, as shown in FIG. 7, the pouring spout 136 of Poirier comprises a single accordion-like tubular section 142 that is formed by a series of ribs 138 that extend between two sleeve sections 144 and 146, and an annular outturned flange 148 on the sleeve 144. In operative position, the spout 136 extends into the fuel receiving tank with the inside face of the flange 148 seated against the outlet of the fuel container. Each rib 138 is circular and formed by frusto-conical walls 152 and 154 that enable the pouring spout 138 to both flex and telescope inwardly and/or outwardly. When the spout is retracted and/or extended and/or bent into a desired shape, the spout retains the shape into which bent. A coupling nut is positioned at the flange 148 to secure the spout 138 to the fuel container.

Additionally, such removability enables the attachment of Wedco spill-proof nozzle, Model No. 40730, such as used in Wedco fuel container models WCA-125, WCA-225, and WCA-525, which nozzle is believed responsive to current California Air Resource Board regulations relating to gas cans. This spill-proof nozzle is used in conjunction with a "no vent" can, prevents the escape of fuel and/or vapors, and shuts off automatically when the receiving tank is full. Similar to the pouring spout 136 described herein above, a coupling nut is used to removably connect the spill-proof nozzle to the pour spout of the fuel container 10. When used in states such as California, the spill-proof nozzle may be used with the fuel container 10 herein above described by replacing the "venting" closure cap 78, removably connected to the inlet of the fill tube 20 of the fuel container 10, with a "no-vent" cap.

While the present invention has been described with respect to specific embodiments, it will be understood that from the foregoing detailed description and accompanying drawings that various modifications and variations will occur to those skilled in the art. Such modifications and variations are intended to fall within the scope of the appended claims.

What is claimed is:

1. A hand held fuel storage container for pouring fuel into a receiving tank, the container comprising:

a housing, said housing having a bottom end wall, an upper end wall, and a generally cylindrical sidewall extending between the endwalls, a fill tube for introducing fuel into said housing, said fill tube having opposite ends with one of said ends connected to said sidewall and communicating with the interior of said housing and the other of said ends spaced upwardly from said upper end wall and forming an inlet to receive and introduce fuel into said fill tube, a pour spout for dispensing fuel from said housing, said pour spout having opposite end portions with one of said end portions connected to the upper end wall and communicating with the interior of said housing and the other of said end portions spaced upwardly from the upper end wall, said other end portion being insertable into a receiving tank and forming an outlet to dispense fuel from said housing and into said receiving tank, an axially compressible sleeve disposed about the dispensing end portion of said pour tube, said sleeve including a rearward end fixedly secured to the pour tube and a forward end positioned proximate to the discharge end of the pour tube, wherein insertion of the pour spout into the receiving tank substantially simultaneously acts to bring the forward end of the sleeve into vapor sealing relation about the inlet to the receiving tank and the sleeve to axially compress and expose and permit a greater forward end portion of said pour tube to be inserted into the receiving tank, a removable closure cap for selectively closing the inlet end of said fill tube, said closure cap including a top wall and a sidewall, said top wall having an upper surface exposed to outside air and a lower surface, and said sidewall closing said cap sidewall and forming an annular recess below said lower surface, and vent means for allowing the passage of air through said closure cap and into said fill tube to promote fuel flow through said pour tube, said vent means comprising an interior chamber in said cap top wall, a bore extending between said interior chamber and the upper surface of said top wall, a passage extending between said chamber and the lower surface of said top wall, and a valve, said valve being disposed in said bore and movable between first and second positions, respectively, for permitting and preventing outside air to pass between the upper and lower surfaces of the cap.

2. The fuel storage container as claimed in claim 1, wherein said valve has forward and rearward ends, respectively, disposed within said interior chamber and above said upper surface, a central passageway extending rearwardly from the forward end, and a radial passageway proximate to the rearward end of said valve, and said radial passageway, when said valve is in said first and second positions, respectively, is above the upper surface, wherein to permit entry of air into the central passageway, and below the upper surface and enclosed by the bore, wherein to prevent entry of air into the central passageway.

3. The fuel storage container as claimed in claim 2, wherein the interior chamber includes a chamber wall, said chamber wall including a detent, and the forward end of said valve is has a shape complementary to the shape of said detent, said forward end being adapted to seat within said detent and close the opening to the central passageway, wherein to prevent backflow of fuel thereinto when the valve is in the second position.

4. The fuel storage container as claimed in claim 1, further comprising a handle for positioning and carrying said container, and wherein said fill tube and said pour spout are spaced from one another and integrally formed with the container, and said handle comprises, at least in part, a handle portion, connected to the sidewall of said container, and said fill tube.

5. A hand held fuel container for receiving and dispensing fuel, the fuel container comprising:

upper and lower endwalls and a sidewall extending between said endwalls, said walls cooperating to form an interior chamber for receiving fuel, a pour tube for dispensing fuel into a receiving tank, said pour tube including an inlet end connected to said upper endwall for receiving fuel from the chamber and a discharge end adapted to be inserted into the receiving tank for dispensing fuel thereinto, a fill tube for receiving and introducing fuel to the interior chamber, the fill tube being spaced from the pour tube and having an inlet end connected to said sidewall and an outlet end for receiving fuel, a closure cap, said closure cap being removably connected in closing relation to the outlet end of said fill tube and provided with an air passage for passing air external to said chamber into said fill tube when said cap is connected to said fill tube, and wherein said closure cap includes a closure valve for permitting and preventing said external air to pass through said air passage, and an axially elongated and axially compressible sleeve disposed in coaxial relation about said pour tube, said sleeve having a forward end fixed in sealed relation to the pour tube and a rearward end positioned rearwardly of the discharge end of the pour tube and adapted to retract rearwardly and towards said rearward end, the forward end being configured for sealing about the inlet opening of the receiving tank when the discharge end of the pour tube is inserted into the receiving tank wherein to inhibit vapors from escaping to the atmosphere during dispensing.

6. A portable hand held fuel container, comprising a pour tube having a lower end connected to the container and an outlet end for dispensing fuel from the container, a fill tube having a lower end connected to the container and an inlet end for introducing fuel into the container, said fill tube being separate and apart from the pour tube, a removable closure cap to close the inlet end to the fill tube, a vent arrangement in the closure cap that permits and prevents exterior air to enter to fill tube to enhance pouring and inhibit fluid flow through the fill tube in case of overturning of the container, and a vapor seal member connected to the outlet end portion of the pour tube, said seal member comprising a cylindrical sleeve having a rearward and forward end portion, respectively, fixed to and movably disposed at the dispensing end of the pour tube and adapted during pouring to simultaneously seal about the fuel inlet to a fuel receiving tank and axially compress rearwardly of the outlet end wherein to permit deep insertion of the outlet end of the pour tube into the receiving tank, said cylindrical sleeve being comprised of a continuous succession of longitudinally spaced undulations to enable axial compression of the sleeve.

7. The portable hand held fuel container as claimed in claim 6, wherein the forward end portion of said cylindrical sleeve forms a frusto-conical end face, said end face being adapted to force the sleeve axially rearwardly upon engagement with the fuel tank.

8. The portable hand held fuel container as claimed in claim 6, wherein said closure cap includes a lower surface and an upper surface, said lower surface being juxtaposable, at least in part, against the inlet end of the fill tube, and said vent arrangement comprises said closure cap including a central chamber, an elongated valve stem mounted for movement relative to the closure cap, the stem including an upper end portion positionable above said upper surface and within said closure cap and a lower end portion in said central chamber, a first passageway for communicating air from the upper end portion to the lower end of the stem, and a second passageway extending between the chamber and the lower surface of said closure cap.

9. The portable hand held fuel container as claimed in claim 6, wherein said container includes an upper endwall, a sidewall, and a central geometrical axis, and said pour tube includes an upper end portion and a lower end portion, the end portions being disposed at an acute angle to one another, and the lower end portion being substantially aligned with the central geometrical axis and projecting generally coaxially from the upper endwall of the container.

10. The portable hand held fuel container as claimed in claim 6, wherein said container includes an upper endwall, a sidewall, and a central geometrical axis, and said fill tube includes an upper end portion and a lower end portion, the end portions being disposed at an acute angle to one another, wherein the lower end portion extends at an acute angle to the sidewall of the container, and the upper end portion is disposed in generally parallel relation to the central geometrical axis of the container.

11. The portable hand held fuel container as claimed in claim 6, wherein said container comprises a top endwall, a flat bottom endwall, and a generally cylindrical sidewall extending between the endwalls, the sidewall being defined by a central geometrical axis, and each said tube has a lower end portion and an upper end portion disposed at an acute angle to the upper end portion, wherein the lower end of the fill tube is connected to the sidewall and the lower end of the pour tube is connected to the top end wall.

12. The portable hand held fuel container as claimed in claim 11, further comprising a handle for carrying and positioning said container, said handle comprising an upper handle portion and a lower handle portion, said upper and lower handle portions being integrally formed with and projecting from the sidewall of the container, and said upper handle portion comprising a portion of the fill tube disposed above the top endwall of the container.

13. The portable hand held fuel container as claimed in claim 12, wherein the top end wall of the container is generally conical in shape and forms a narrowed throat portion, the narrowed throat portion of the top wall forming the inlet to the pour tube, and the upper end of the fill tube and the narrowed throat portion are approximately at the same level.

14. A closure cap for closing the inlet end of a fill tube of a fuel container, the closure cap comprising:

a circular top wall and a cylindrical sidewall, said sidewall encircling said top wall and adapted to secure to the inlet end of the fill tube, and said top wall having upper and lower surfaces, said upper surface defining an exterior surface exposed to the atmosphere and said lower wall defining and an interior surface adapted to be juxtaposed against the inlet end of the fill tube, passage means for passing air between the upper and lower surfaces of said top wall, wherein said passage means includes a central chamber, and first and second passages, respectively, for communicating air between said central chamber and said upper surface and between said central chamber and said lower surface, and a manually operated valve mounted in the cap for movement between a first position and a second position, the first position permitting air to pass through said passage means and the second position preventing air to pass through said passage means.

15. The closure cap as claimed in claim 14, further comprising:

a boss projecting from said upper surface of said top wall, said boss including a bore therethrough, and wherein said chamber is disposed between said upper and lower surfaces and said first air passage extends through said boss to communicate outside air to said chamber.

16. The closure cap as claimed in claim 15, wherein said bore is provided with thread, said valve comprises an elongated stem, the stem having first and second ends, a threaded exterior, a central passage extending rearwardly from an opening formed at the first end, and a radial passage proximate to the second end, said stem being threadably engaged with the threaded bore for relative axial movement thereto, and said radial passage opening on the exterior of said stem and extending between the opening and the central passage, and said first passage comprises said central and radial passages, wherein movement of the stem positions the radial passage and opening thereof above the upper surface of said cap, wherein to permit air to pass into the chamber and through the second passage, and below the upper surface of said cap and into closed relation with the wall of the bore, wherein to prevent air and fluids to pass through the passage means.

17. The closure cap as claimed in claim 15, further comprising a valve head formed at the second end of said valve stem to manipulate said valve, wherein a first seal member, said first seal member being disposed between the valve head and the upper end face of the boss and adapted to be compressed against the end face by the head when the valve stem is in the closed position wherein to seal the interface therebetween, and a second seal member, said second seal member being seated against the lower surface of said top wall and adapted to be compressed against the inlet end face of the fill tube wherein to seal the interface therebetween.

18. A hand held fuel storage container for pouring fuel into a receiving tank, the container comprising:

a fill tube, said fill tube including an inlet for introducing fuel into the container, a vent cap, said vent cap removably connected to said inlet and including a valve movable between open and closed positions for selectively permitting and preventing the passage of air into the fill tube wherein to promote fuel flow from said container, an outlet spaced from said fill tube, said outlet for dispensing fuel from said container, a fuel dispensing subassembly, said fuel dispensing subassembly comprising the pouring spout as shown in FIG. 7, and means for removably connecting said fuel dispensing subassembly to said outlet.

19. A hand held fuel storage container for pouring fuel into a receiving tank, the container comprising:

a fill tube, said fill tube including an inlet for introducing fuel into the container, a vent cap, said vent cap removably connected to said inlet and including a valve movable between open and closed positions for selectively permitting and preventing the passage of air into the fill tube wherein to promote fuel flow from said container, an outlet spaced from said fill tube, said outlet for dispensing fuel from said container, a fuel dispensing subassembly removably connected to said outlet, and means for coupling said subassembly to said outlet, said fuel dispensing subassembly comprising a section of tubing having an inlet end and a discharge end, and an axially compressible sleeve disposed about the section of tubing and having rearward and forward ends, respectively, proximate to the inlet and discharge ends, wherein said rearward end is fixedly secured to the section of tubing, said forward end is adjacent to the discharge end of the pour tube, and insertion of the discharge end into the receiving tank substantially simultaneously acts to bring the forward end of the sleeve into vapor sealing relation about the inlet to the receiving tank and axially compress and permit a greater forward end portion of said tubing section to be inserted into the receiving tank.

* * * * *